US005315941A

United States Patent [19]

Vetterick et al.

[11] Patent Number: 5,315,941

[45] Date of Patent: May 31, 1994

[54] METHOD AND APPARATUS FOR INJECTING NOX INHIBITING REAGENT INTO THE FLUE GAS OF A BOILER

[75] Inventors: Richard C. Vetterick, Akron; Donald C. Langley, North Canton, both of Ohio

[73] Assignee: The Babcock & Wilcox Company, New Orleans, La.

[21] Appl. No.: 72,257

[22] Filed: Jun. 7, 1993

[51] Int. Cl.[5] ..... F23J 15/00

[52] U.S. Cl. ..... 110/345

[58] Field of Search ..... 110/344, 345, 234

[56] References Cited

U.S. PATENT DOCUMENTS 4,208,386 6/1980 Arand et al. ..... 423/235

4,842,834 6/1989 Burton ..... 423/235

4,985,218 1/1991 DeVita ..... 423/235

5,058,514 10/1991 Mozes et al. ..... 110/345

5,176,088 1/1993 Amrhein et al. ..... 110/345

5,242,295 9/1993 Ho ..... 110/345 X

*Primary Examiner*—William E. Tapolcai

*Attorney, Agent, or Firm*—Robert J. Edwards

[57] ABSTRACT

An apparatus and method including a conduit with a nozzle for injecting $NO_x$ inhibiting reagent into an appropriate temperature window in the flue gas of a package, utility, or industrial type boiler to reduce emissions of $NO_x$. A sensor mounted adjacent the nozzle to measure the flue gas temperature thereby locating the appropriate temperature window, and a controlled drive for moving the nozzle to the temperature window.

6 Claims, 3 Drawing Sheets

METHOD AND APPARATUS FOR INJECTING NOX INHIBITING REAGENT INTO THE FLUE GAS OF A BOILER

FIELD AND BACKGROUND OF THE INVENTION

The present invention relates to a method and apparatus for injecting $NO_x$ inhibiting reagent into the flue gas of a boiler, in order to reduce the emission of $NO_x$.

$NO_x$ emissions are a common problem encountered during the operation of boilers due to extremely high temperatures involved in boiler operations. Concern for the environment has resulted in the development of several methods and devices to combat the $NO_x$ pollutant problem.

U.S. Pat. No. 4,208,386 discloses a process for reducing $NO_x$ emissions found in combustion effluent, through the use of urea or a urea solution sprayed onto the flue gas having a temperature window of 1300° F. to 2000° F. It has been found that $NO_x$ control is best if the reagent is injected within this temperature window.

U.S. Pat. No. 4,842,834 discloses a process and apparatus for reducing the concentration of pollutants in flue gas due to combustion of the fuel. An effluent treatment fluid is injected at independently variable droplet sizes and distances into a wide variety of distribution patterns within the flue gas passage. An atomization conduit extends into the flue gas and is positioned coaxially around a treatment fluid conduit to supply an atomization fluid.

U.S. Pat. No. 4,985,218 discloses a process and apparatus for reducing $NO_x$ concentrations in a flue gas from a combustion chamber. The process and apparatus enable the injection of a flue gas treatment fluid at a low treatment fluid flow rate, yet provide an even dispersion of treatment fluid within the flue gas passage with little or no clogging. An atomization conduit, positioned coaxially within a treatment fluid supply conduit, extends into the flue gas and supplies an atomization fluid, such as steam or air. A treatment fluid is supplied through a supply conduit and through at least one jet in the atomization conduit wall at a velocity of between 2 to 60 feet per second, causing atomization of the treatment fluid within a nozzle. The treatment fluid used to reduce $NO_x$ emissions is preferably comprised of an aqueous solution of urea, ammonia, nitrogenated hydrocarbon, oxygenated hydrocarbon, hydrocarbon or combinations thereof.

U.S. Pat. No. 5,058,514 discloses a process for controlling acid gas emissions in flue gases. An in-furnace injection process is used to control both $SO_2$ and $NO_x$ emission from the flue gases. A reagent aimed at reducing the pollutants is injected into the furnace at a temperature range or window between 900° C. to 1350° C. At optimal operating conditions, about 80% of the $SO_2$ and 90% of the $NO_x$ are removed. Similarly, urea has been found to be the preferred nitrogenous progenitor additive. The urea can be injected in a cross current, concurrent or counter current direction to the flue gas flow.

On most occasions, the ability to inject the reactant into a specified temperature window has presented several application problems. one such problem is caused due to the appropriate temperature window moving upstream gas flow-wise with a decrease in boiler load and downstream with an increase in load. Due to varying load changes within the boiler, a given flue gas temperature will move back and forth in relation to boiler load changes. Thus, varying boiler load causes a shifting of temperatures within the flue gas chamber so that injection may not take place at the appropriate flue gas temperature.

SUMMARY OF THE INVENTION

The present invention is a method and apparatus for injecting $NO_x$ inhibiting reagent into the flue gas of a package, utility, or industrial type boiler, in order to reduce the emission of $NO_x$.

The main goal of the present invention is to enable $NO_x$ reagent to be used in the appropriate temperature window, the most efficient location within the flue gas chamber, in order to maximize pollution control efficiency. The present invention achieves this goal by employing a conduit and dispersion nozzle that is inserted into the flue gas chamber in order to disperse a reagent aimed at reducing $NO_x$ emissions from a boiler. Urea is one such $NO_x$ inhibiting reagent that can be used to reduce pollutants. A temperature sensor is located on the conduit in order to monitor the flue gas temperature. The temperature sensor relays the temperature within the flue gas chamber to a control device. In turn, the control device commands drive means that are responsible for the moving and repositioning of the conduit and dispersion nozzle into the appropriate temperature window, preferably about 1600°-1900° F., found to be the optimal reagent spraying location within the flue gas chamber. This insures an efficient and uniform $NO_x$ emission reduction because the conduit with temperature sensor allows for automatic adjustments to be made during boiler operation to compensate for load changes.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

Figure 1:
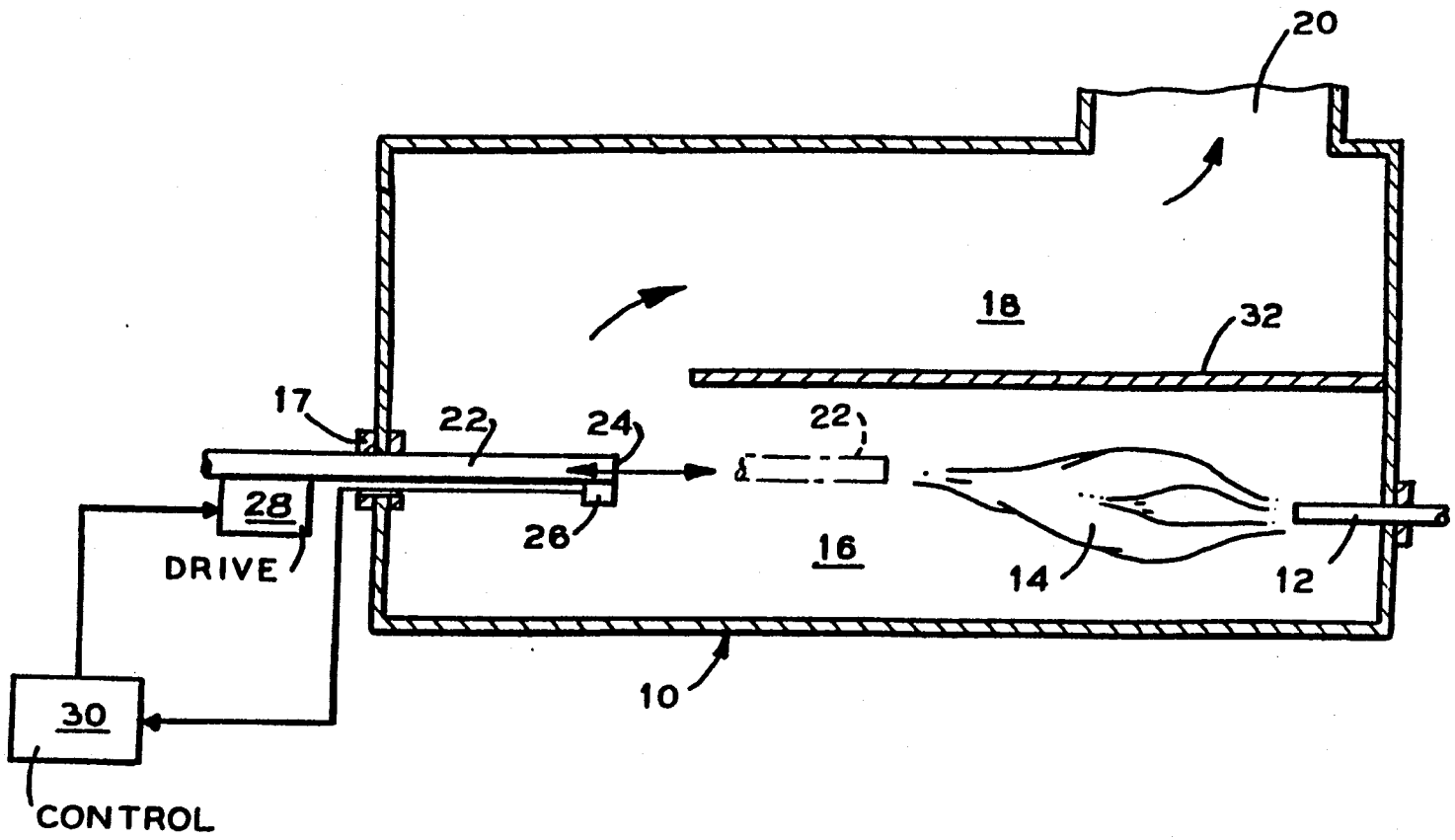
FIG. 1 is a horizontal sectional view of a package boiler with the present invention combined therewith.
Figure 2:
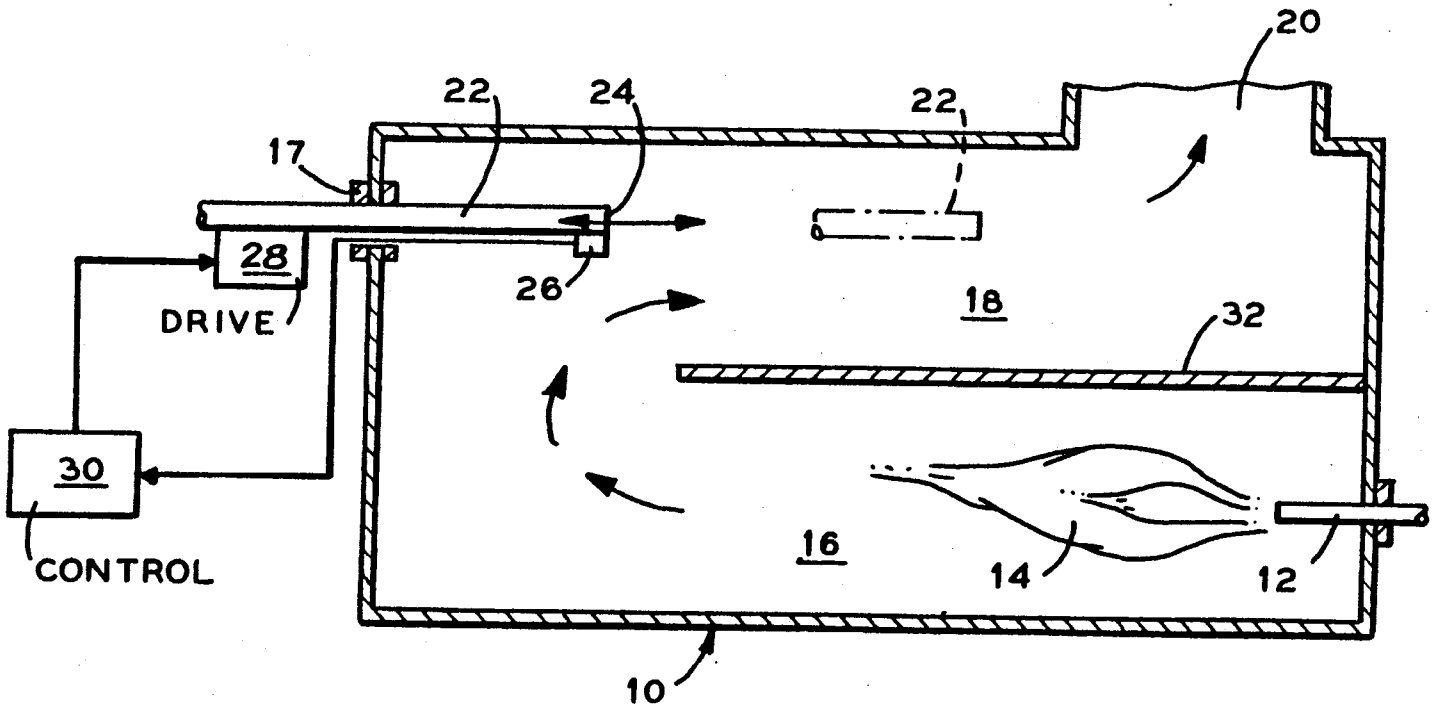
FIG. 2 is a horizontal sectional view of a package boiler with an alternate embodiment of the present invention combined therewith.

Referring to the drawings in particular, the invention embodied in FIGS. 1 and 2 comprises a package boiler 10 containing a burner 12 and provided with a water tube wall lined furnace chamber 16 of rectangular cross-section and a convection pass or passage 18 containing heat exchangers (not shown) which are also in the form of water tube walls and/or a superheater formed for serial flow of steam by multiple looped tubes. A water tube wall partition 32 separates the furnace chamber 16 from the adjacently positioned convection pass 18.

In the normal operation of the boiler 10, combustion air and fuel are supplied to the burner 12 and the fuel is burned as shown at 14 in the furnace chamber 16. Heating gases flow through the convection pass 18 and out through a duct 20 for discharge from a stack (not shown).

A $NO_x$ inhibitor conduit 22 is inserted through a slide seal 17 and into the furnace chamber 16, as shown at FIG. 1, or the convection pass 18, as shown at FIG. 2, of the package boiler 10. A nozzle 24 is located on the outlet end of conduit 22 in order to disperse a $NO_x$ inhibitor reagent into the flue gas flowing through the furnace chamber 16, as shown at FIG. 1, or the convection pass 18, as shown at FIG. 2.

A temperature transducer 26 is also located on the conduit 22 and is used to monitor the flue gas temperature and locate the proper temperature window (about 1600°-1900° F.) within the furnace chamber 16 or the convection pass 18. As the temperature transducer 26 monitors the flue gas temperature within the furnace chamber 16 or the convection pass 18, it relays the temperature reading to control means 30. Based on the temperature reading relayed from the temperature transducer 26 to the control means 30, the control means will activate a drive 28 which is responsible for moving and positioning the $NO_x$ inhibitor conduit 22 within the furnace chamber 16 or the convection pass 18 in order to move nozzle 24 to the location of the appropriate temperature window.

Seal 17 may be of any conventional type and may be established, for example, by directing a continuous stream of air around and against the conduit 22 and into the furnace chamber 16 or the convection pass 18, to substantially preclude any leaking of flue gases from the furnace chamber 16 or the convection pass 18, around the slidably mounted conduit 22.

Figure 3:
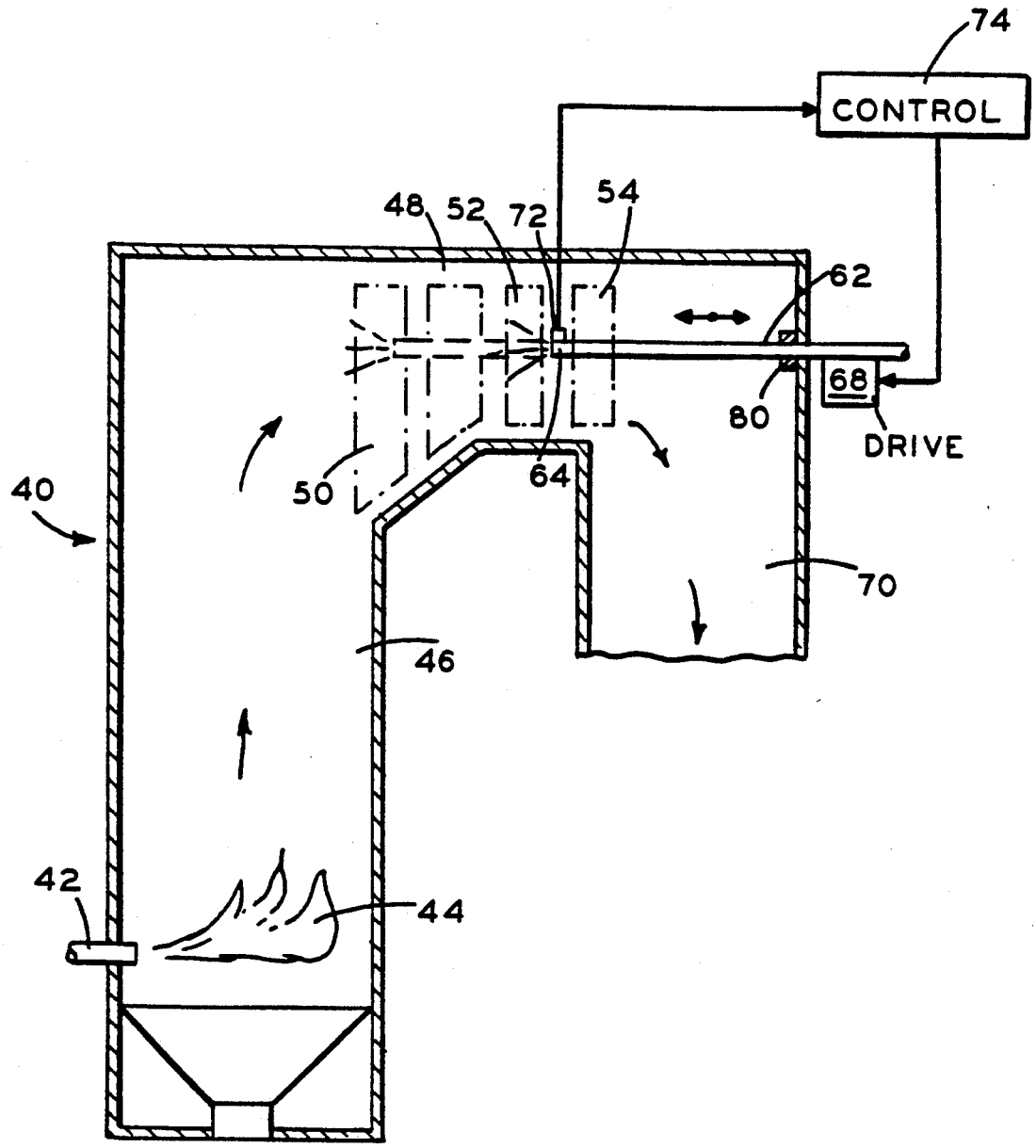
FIG. 3 is a side sectional view of a utility or industrial boiler with the present invention combined therewith.

FIG. 3 illustrates a utility or industrial boiler 40 containing multiple burners shown as a single burner 42, located in a water tube wall lined furnace chamber 46. In the normal operation of the boiler 40, combustion air and fuel are supplied to the burner 42 and the fuel is burned as shown at 44 in the lower portion of furnace space 46. Heating gases flow upwardly through space 46, thence to a convection pass or passage 48 and then successively over and between the tubes of a secondary superheater 50, a reheater 52, and a primary superheater 54 and downwardly through a gas passage 70. The economizer, air heater, dust collector and stack successively located downstream gas flow-wise in and from the passage 70 and normally associated with a utility or industrial boiler are not shown. In the embodiment shown at FIG. 3, the secondary superheater 50, the reheater 52 and the primary superheater 54 extend across the full width of the convection pass 48 and are formed for serial flow of steam by multiple looped tubes.

A $NO_x$ inhibitor conduit 62 is inserted in a slide seal 80 located in the convection pass 48 so that conduit 62 can pass between the tubes of the secondary superheater 50, reheater 52 and primary superheater 54. A nozzle 64 is located on the conduit 62 so that reagent is dispersed into the flowing flue gas. A temperature sensor 72 is also located on the conduit 62 so that it can monitor the temperature of the flue gas inside the convection pass 48 and relay the temperature to a control 74. Upon receiving the temperature reading from the temperature sensor 72, the control 74 will direct a drive 68 which is responsible for the movement and positioning of the $NO_x$ inhibitor conduit 62 within the convection pass 48. The combination of the temperature sensor 72, the control 74 and the drive 68 ensures that the appropriate temperature window is located and the $NO_x$ emissions are most efficiently reduced before the flue gas is discharged from the stack (not shown).

Although in FIGS. 1, 2 and 3, the conduit is mounted for sliding parallel to the flue gas flow direction, it may also be mounted for movement at an angle or in a curved path. The motion must be generally along the path of temperature change.

The reagent is preferably in the liquid phase, however, the invention will accommodate gaseous and powdered solid phase reagents as well.

While the specific embodiments of the invention have been shown and described in detail to illustrate the application of the principles of the invention, it will be understood that the invention may be embodied otherwise without departing from such principles.

What is claimed is:

1. An apparatus for injecting $NO_x$ inhibiting reagent into a boiler flue gas, wall means defining a gas passage for the flow of the flue gas, the reagent best inhibiting $NO_x$ formation at a temperature window, the flue gas temperature at the window changing with changing boiler load, the apparatus comprising:

a conduit having a nozzle for injecting $NO_x$ inhibiting reagent into the flue gas;

mounting means for movably mounting the conduit to the wall means for changing nozzle position;

drive means operatively connected to the conduit for moving the conduit along the mounting means;

a temperature sensor for sensing the flue gas temperature to locate the temperature window; and control means connected between the drive means and the temperature sensor for operating the drive means to move the nozzle to the temperature window.

2. An apparatus according to claim 1, wherein the conduit is slidably connected to the mounting means.

3. An apparatus according to claim 1, wherein the nozzle is moved in a direction parallel to the flow of flue gas.

4. A method for injecting $No_x$ inhibiting reagent into a boiler flue gas, wall means defining a gas passage for the flow of the flue gas, the reagent best inhibiting $NO_x$ formation at a temperature window, the flue gas temperature at the window changing with changing boiler load, the method comprising:

inserting a conduit having a nozzle for injecting $NO_x$ inhibiting reagent into the flue gas;

movably mounting the conduit to the wall means for changing the nozzle position;

sensing the flue gas temperature to locate the temperature window; and moving the nozzle to the temperature window.

5. A method according to claim 4, wherein the temperature is sensed by a sensor located adjacent the nozzle.

6. A method according to claim 4, wherein the conduit is moved parallel to the gas flow direction.

* * * * *